United States Patent [19]

Nagashima et al.

[11] Patent Number: 5,067,170

[45] Date of Patent: Nov. 19, 1991

[54] ELECTRIC WATER WARMING SYSTEM

[75] Inventors: Seiko Nagashima, Ibaraki; Takanobu Serizawa, Susono, both of Japan

[73] Assignee: Kabushiki Kaisha Toshiba, Kawasaki, Japan

[21] Appl. No.: 457,496

[22] Filed: Dec. 27, 1989

[30] Foreign Application Priority Data

Jan. 5, 1989 [JP] Japan ..... 64-629

[51] Int. Cl.[5] ..... F24H 1/18

[52] U.S. Cl. ..... 392/461; 392/339; 392/441; 392/449; 392/458; 392/465; 392/471

[58] Field of Search ..... 219/312, 310, 279, 297, 219/281; 99/279; 165/56; 126/344, 422, 437; 137/255, 561; 392/311, 314, 319, 320, 322, 325, 339, 341, 441, 442, 449, 450, 454, 456, 458, 461, 465, 471, 479, 480

[56] References Cited

U.S. PATENT DOCUMENTS

| | | | |
|---|---|---|---|
| 1,269,053 | 6/1918 | Clark et al. | 392/462 |
| 1,715,035 | 5/1929 | Hoyt | 219/439 |
| 4,044,949 | 8/1977 | Morawetz et al. | 126/422 |
| 4,242,569 | 12/1980 | Kayser | 392/358 |

*Primary Examiner*—Bruce A. Reynolds

*Assistant Examiner*—Tu Hoang

*Attorney, Agent, or Firm*—Oblon, Spivak, McClelland, Maier & Neustadt

[57] ABSTRACT

An electric water warming system generally comprises a cylindrical first water storage tank to be installed in a vertical fashion, a water feed pipe connected to a bottom portion of the first water storage tank for feeding water therein, and a hot water flow-out pipe connected to a top portion of the water storage tank for flowing out hot water therefrom. A temperature of hot water stored in the water storage tank is detected by a detecting device at a plurality of levels thereof and a water feed side and a water flow-out side are connected through a circulation pipe. A second water storage tank is incorporated in the circulation pipe and a heater is disposed in the second water storage tank. A temperature of the hot water in the second tank is detected by another detecting device disposed at an outlet portion of the second water tank. A circulation pump is incorporated in the circulation pipe at a portion upstream of the second water storage tank. The detecting devices are connected to a controlling unit for controlling the heater and the circulation pump to securely maintain the hot water of the predetermined temperature in the first hot water storage tank without exhaustion.

5 Claims, 2 Drawing Sheets

ELECTRIC WATER WARMING SYSTEM

BACKGROUND OF THE INVENTION

This invention relates to an electric water warming system capable of feeding hot water from a hot water storage tank and, more particularly, to an electric water warming system including a heating temperature controlling apparatus for the stored hot water.

An electric water warmer of this kind is utilized suitably for domestic use and operates such that water fed into a hot water storage tank of the water warmer is heated on, for example, a cheep late-night power to increase a temperature of a fed water and is stored in the storage tank as a hot water.

In a conventional art of this field, there is provided an electric water warming system of hot water storage type which comprises a hot water storage tank having generally a cylindrical shell provided with a bottom portion to which is connected a water feed pipe and an upper portion to which is connected a hot water flow-out pipe. A heating means such as a heater is mounted to an inside wall of the hot water storage tank so as to extend substantially horizontally and the heater is disposed at a portion near the bottom portion of the hot water storage tank so as to heat the water fed into the storage tank through the water feed pipe.

The water fed into the storage tank is heated by conducting electric current to the heater and the heated water gradually rises in the storage tank and stored therein from the upper portion thereof. Namely, the heated hot water is stored in the hot water storage tank with a temperature rising characteristic curve, substantially linear curve from the lower portion towards the upper portion of the stored water, so that the hot water temperature even at the lower portion is kept above a set temperature of a predetermined value.

However, since the temperature of the hot water in the entire hot water storage tank is regulated so as to be kept to the set value, when the hot water of high temperature in the upper portion of the storage tank is flown out rapidly in a short time outward through the flow-out pipe, the exhaustion of the hot water having a temperature above the predetermined value may be caused. In such case, it will become impossible to obtain a hot water of desired temperature required for a user for the reason that a lot of water fed through the water feed pipe cannot be rapidly heated to the set value entirely in the hot water storage tank even by the electric conduction to the heater, and accordingly, a hot water having a temperature below the set value will be temporarily stored. Therefore, there may be a case where hot water having a desired temperature cannot be utilized continuously, which results in defect in function of the hot water storage system of the type described.

SUMMARY OF THE INVENTION

An object of this invention is to eliminate the defects and drawbacks encountered in the prior art described above and to provide an electric water warming system having a simple structure and being capable of effectively obviating exhaustion of hot water in a hot water storage tank and quickly securing the hot water of desired high temperature without substantially effecting adverse function.

This and other objects can be achieved according to this invention by providing an electric water warming system of the type comprising a cylindrical first water storage tank to be installed in a vertical fashion, a water feed pipe connected to a bottom portion of the first water storage tank for feeding water therein, and a hot water flow-out pipe connected to a top portion of the first water storage tank for flowing out hot water therefrom, characterized in that a temperature of hot water stored in the first water storage tank is detected by a detecting means at a plurality of levels thereof, a water feed side and a water flow-out side are connected through a circulation pipe, a second water storage tank is incorporated in the circulation pipe, a heater is disposed in the second water storage tank, another detecting means is disposed at an outlet portion of the second water tank for detecting a temperature of hot water stored in the second water tank, a circulation pump is incorporated in the circulation pipe at a portion downstream of the second water storage tank and adapted to circulate water in the circulation pipe, and a controlling unit for controlling the heater, the first and second detecting means, and the circulation pump is connected respectively thereto.

In preferred embodiments, the detecting means for the first water storage tank comprises a plurality of temperature sensors which are mounted on an outer peripheral surface of the water storage tank with vertically spaced relationship.

The circulation pipe is arranged vertically along the outer periphery of the first water storage tank and the circulation pipe has a lower end connected to a lower portion of the water storage tank or to the first water feed pipe near an inlet portion of the first water storage tank and an upper end connected to an upper portion of the first water storage tank or to the flow-out pipe means near an outlet of the water storage tank.

According to the electric water warming system of the character described above, the circulation pipe is arranged vertically along the vertical direction of the first hot water storage tank provided with the water feed pipe and the hot water flow-out pipe. The circulation pie is equipped with the second hot water tank and the circulation pump. The water in the second tank is heated by the heater disposed therein and the temperature of the hot water in the second tank is detected by the thermistor. The temperature of the hot water in the first storage tank is detected at a plurality of water levels by a plurality of thermistors. These thermistors are connected to the controlling unit, which controls the circulation pump and the heater in response to electric signals form the thermistors for suitable regulating the temperature of the hot water and preventing the hot water of the desired temperature from exhausting.

DESCRIPTION OF THE PREFERRED EMBODIMENTS

Figure 1:
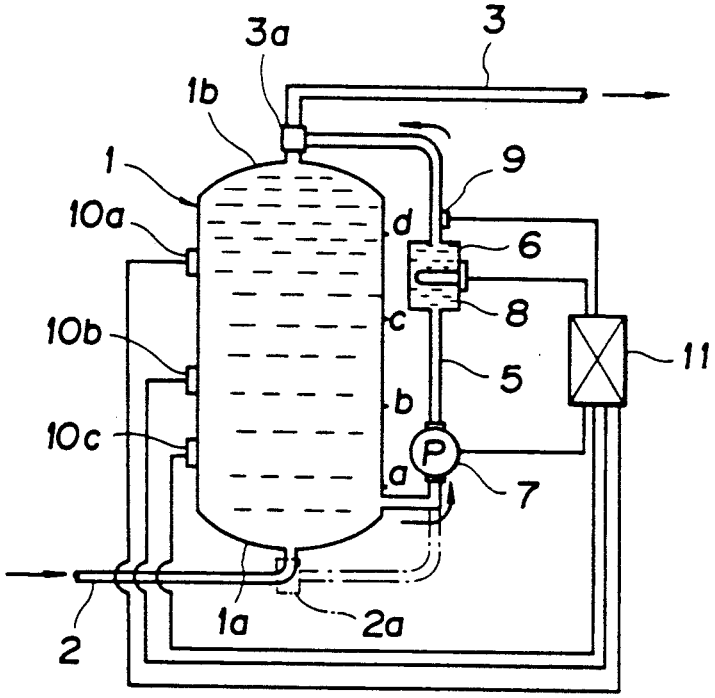
FIG. 1 is an elevational schematic view of one embodiment of an electric water warming system according to this invention.

FIG. 1 shows one preferred embodiment of an electric water warming system according to this invention. Referring to FIG. 1, the electric water warming system comprises a generally cylindrical hot water storage tank 1 The cylindrical hot water storage tank 1 is provided with a lower bottom portion 1*a* to which a water feed pipe 2 is connected an upper top portion 1*b* to which a hot water flow-out pipe 3 is connected. It will be desired that the hot water storage tan 1 has an inner volume of about 200λ for a family of one or two persons; 300λ for two or three persons; 370λ for four or five persons and 460λ for five or six persons of HPL-4622 Type of Toshiba Corporation, for example.

A circulation pipe 5 is connected to the wall of the hot water storage tank 1 so as to connect the lower portion near the bottom of the tank to the upper portion near the top thereof, and in the illustrated embodiment, the circulation pipe 5 has one end connected to the lower portion 1*a* or near the storage tank 1 and another end connected, through a pipe joint 3*a*, to the flow-out pipe 3 near the connecting portion of the flow-out pipe 3 and the top portion 1*b* of the storage tank 1. The lower end of the circulation pipe 5 may be connected to the water feed pipe 2 through a pipe joint 2*a* as shown in dot and dash lines in FIG. 1. In this connection, the hot water storage tank 1 is heated and hence operated as a pressurised tank, so that it may be desirable for the circulation pipe 5 not to connect to the wall of the tank by, for example, welding means in view of the structural strength thereof.

The intermediate portion of the circulation pipe 5 extends upward substantially along the wall of the storage tank 1 on the outside thereof. Another hot water tank 6 is assembled to the intermediate portion of the circulation pipe 5 at the upper portion thereof and a circulation pump 7 is also assembled to the intermediate portion of the circulation pipe 5 at a portion below the hot water tank 6. A heater 8 is mounted to the inner wall surface of the hot water tank 6 to heat the water stored therein to a predetermined temperature, and a temperature sensor 9 such as thermistor for detecting a temperature of the water in the hot water tank 6 is provided for an outlet of the hot water tank 6 and, for example, mounted to the circulation pipe 5.

A plurality of temperature sensors 10*a*, 1O*b* and 1O*c*, three in the illustration, such as thermistors are mounted on the outer peripheral surface of the shell of the hot water storage tank 1 with vertical spaces therebetween and adapted to detect the temperatures of the hot water at the plural portions of the hot water in the storage tank 1. The circulation pump 7, the heater 8, the temperature sensor 9, and the temperature sensors 1O*a*, 1O*b* and 1O*c* are all connected to a controlling unit 11 respectively through electric lead wires to send informations in the form of electric signals from the respective elements to the controlling unit 11. The controlling unit 11 controls the heater 8 and the circulation pump 7 and operates them so as to heat the water in the hot water tank 6 to a desired temperature, for example, of 55 to 90° C. as occasion demands.

In the actual operation of the water warming system of the characters described above, water is preliminarily stored in the storage tank 1 through the water feed pipe 2 and a desired temperature of 80° C., for example, of the water stored is also preliminarily input into the controlling unit 11.

In the next step, a control board, not shown, is operated so as to electrically conduct the circulation pump 7 and the heater 8 to compulsively start the circulation of the water stored in the storage tank 1 through the circulation pipe 5 and to heat the circulating water in the hot water tank 6. The temperature sensors 9 and 10*a*, 10*b* and 1O*c* detect the temperature of the heated water in the tanks 6 and 1, and when the temperatures of the heated waters reach to the preliminarily set values, the temperature sensors transmit signals representing these facts to the controlling unit 11, which accordingly controls and stops the operations of the heater 8 and the circulation pump 7, whereby the hot water of the predetermined temperature is stored in the tank.

In a case, which is rare in actual usage, where the hot water of the predetermined temperature in the hot water storage tank 1 is used up and the storage tank 1 is filled with water of a temperature substantially below the predetermined value, the hot water stored in the hot water tank 6 is heated by the heater 8. When the fact that the temperature of the hot water in the tank 6 increases to the predetermined value of 80° C., for example, is detected, the circulation pump 7 is operated to supply the heated hot water from the tank 6 into the tank 1. In this operation, the circulation pump 7 is controlled by the controlling unit 11 which is operated in response to an electric signal representing the temperature detected by the thermistor 9 provided for the outlet portion of the hot water tank 6. Accordingly, the thus heated hot water is rapidly supplied to the storage tank 1 to fill in only the inner upper portion thereof to be quickly used, thus effectively eliminating the hot water exhaustion phenomenon in the hot water storage tank 1 without substantially losing the hot water storage function thereof.

In the meantime, the temperature of the entire hot water stored in the storage tank 1 can be optionaly controlled by selectively controlling the temperature sensors 10*a*, 10*b* and 10*c* disposed to the tank wall in the vertically spaced arrangement. For example, when a relatively small amount of the hot water is required, the heater 8 and the circulation pump 7 are controlled by the controlling unit 11 so that the hot water is stored at the hot water level in the storage tank 1 corresponding to the thermistor 10*a* mounted to the upper portion of the tank wall. On the other hand, when a relatively large amount of the hot water is required, the heater 8 and the circulation pump 7 are controlled by the controlling unit 11 through the thermistor 1O*c* mounted to the lower portion of the tank wall. As described above, the location of the plural thermistors 10*a* to 10*c* makes it possible to finely control the amount of the hot water to be supplied as occasion demands, thus being economical for the consumption of the hot water.

Figure 2:
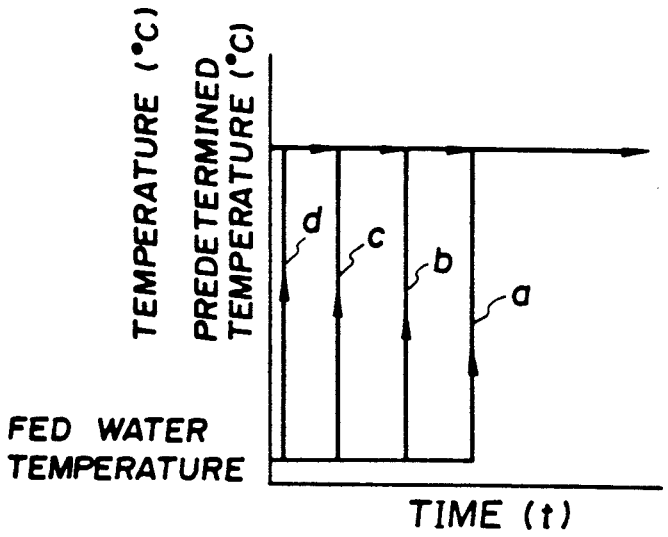
FIG. 2 is a graph representing a temperature rising characteristic curve regarding the electric water warming system of FIG. 1.

FIG. 2 is a graph representing the temperature rising characteristic curves a, b, c and d showing the temperatures of the hot water in the storage tank 1 at the water levels of a, b, c and d shown in FIG. 1 from the lower side thereof. As is apparent from FIG. 2, according to this invention, the hot water of the predetermined temperature can be maintained entirely in the hot water storage tank 1.

Figure 3:
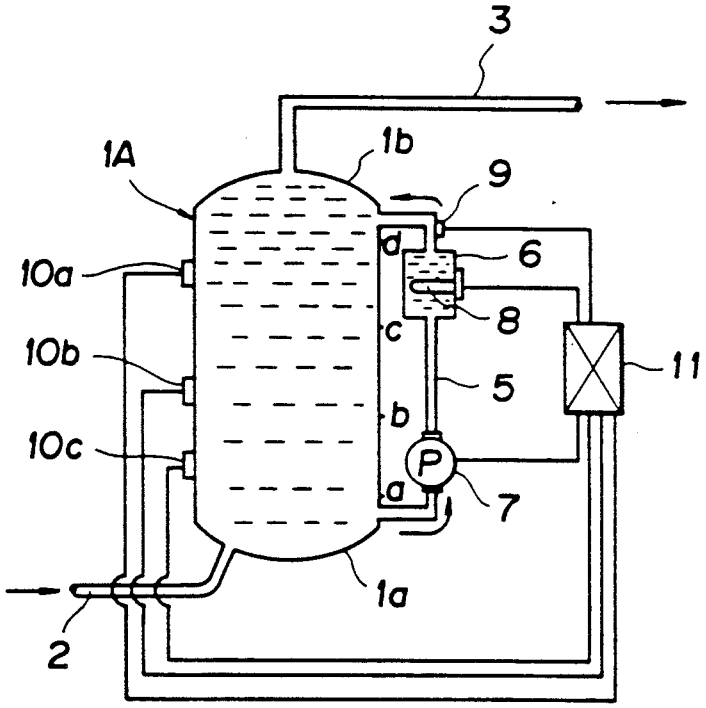
FIG. 3 is an elevational schematic view of another embodiment of an electric water warming system according to this invention.

FIG. 3 shows another embodiment of an electric water warming system according to this invention, in which like reference numerals are added to members or elements corresponding to those shown in FIG. 1. The embodiment of FIG. 3 differs from that of FIG. 1 only in the connection of the circulation pipe 5 to the hot water storage tank 1A. Referring to FIG. 3, the lower and upper ends of the circulation pipe 5 are connected to the side wall of the hot water storage tank 1A by, for example, welding means. This connection of the circulation pipe 5 eliminates the usage of joint members such as 2*a* and 3*a*of the first embodiment shown in FIG. 1.

It is to be understood by persons skilled in the art that this invention is not limited to the described embodiments and many other changes and modifications may be made without departing from the scopes and spirit of the appended claims.

What is claimed is:

1. An electric water warming system comprising:

a first water storage tank to be installed in a vertical fashion;

a water feed pipe means connected to a bottom portion of said first water storage tank for feeding water therein;

a hot water flow-out pipe means connected to a top portion of said first water storage tank for flowing out not water therefrom;

a first detecting means for detecting a temperature of hot water stored in te first water storage tank at a plurality of levels thereof;

a circulation pipe means for circulating water from a water feed side to a hot water flow-out side of said first water storage tank;

a second water storage tank incorporated in said circulation pipe means, said second water storage tank having an inlet portion and an outlet portion;

a heating means disposed in said second water storage tank;

a second detecting means disposed at the outlet portion of said second water storage tank for detecting a temperature of hot water stored in said second water storage tank, said second detecting means comprising a temperature sensor mounted on said circulation pipe means near the outlet portion of said second water storage tank;

a pump means incorporated in said circulation pipe means at a portion between an upstream side of said second water storage tank and a downstream side of said first water storage tank to circultate water in said circulation pipe means; and means for controlling said heating means, said first and second detecting means and said pump means, and regulating temperatures of the hot waters through said first and second detecting means.

2. An electric water warming system according to claim 1, wherein said first detecting means comprises a plurality of temperature sensors which are mounted on an outer peripheral surface of said first water storage tank with vertically spaced relationship.

3. An electric water warming system according to claim 1, wherein said circulation pipe means is arranged vertically along the outer periphery of said first water storage tank and said circulation pipe means has a lower end connected to a lower portion of said first water storage tank and an upper end connected to said flow-out pipe means near an outlet of said first water storage tank.

4. An electric water warming system according to claim 1, wherein said circulation pipe means has a lower end connected to said water feed pipe means at a portion near an inlet of said first water storage tank and an upper end connected to said flow-out pipe means near an outlet of said first water storage tank.

5. An electric water warming system according to claim 1, wherein said circulation pipe means has a lower end connected to a lower portion of said first water storage tank and an upper end connected to an upper portion of said first water storage tank.

* * * * *